US009190737B2

(12) United States Patent
Sano et al.

(10) Patent No.: US 9,190,737 B2
(45) Date of Patent: Nov. 17, 2015

(54) WAVEGUIDE SLOT ANTENNA

(71) Applicant: TOKO, INC., Saitama (JP)

(72) Inventors: Kazuhisa Sano, Saitama (JP); Yukikazu Yatabe, Saitama (JP); Kazuhiro Ito, Saitama (JP)

(73) Assignee: TOKO, INC., Saitama (JP)

( * ) Notice: Subject to any disclaimer, the term of this patent is extended or adjusted under 35 U.S.C. 154(b) by 195 days.

(21) Appl. No.: 13/730,134

(22) Filed: Dec. 28, 2012

(65) Prior Publication Data

US 2013/0194145 A1 Aug. 1, 2013

(30) Foreign Application Priority Data

Dec. 28, 2011 (JP) ..... 2011-287343

(51) Int. Cl.
*H01Q 13/10* (2006.01)
*H01Q 15/24* (2006.01)
*H01Q 13/22* (2006.01)

(52) U.S. Cl.
CPC ..... *H01Q 15/244* (2013.01); *H01Q 13/10* (2013.01); *H01Q 13/22* (2013.01)

(58) Field of Classification Search
CPC ..... H01Q 13/10; H01Q 13/22; H01Q 15/24; H01Q 15/242; H01Q 15/244
USPC ..... 343/767, 770, 756
See application file for complete search history.

(56) References Cited

U.S. PATENT DOCUMENTS

| | | | | |
|---|---|---|---|---|
| 5,030,965 | A * | 7/1991 | Park et al. | 343/770 |
| 6,028,562 | A | 2/2000 | Guler et al. | |
| 6,414,645 | B1 * | 7/2002 | Dahlberg | 343/767 |
| 2002/0190910 | A1 | 12/2002 | Solbach | |
| 2012/0068900 | A1 | 3/2012 | Yatabe et al. | |

FOREIGN PATENT DOCUMENTS

| | | |
|---|---|---|
| CN | 101479887 | 7/2009 |
| JP | 2000-341030 | 12/2000 |
| JP | 2002-237715 | 8/2002 |
| JP | 2003-037432 | 2/2003 |
| JP | 2003-133850 | 5/2003 |
| JP | 2005-217865 | 8/2005 |
| JP | 2008-113314 | 5/2008 |
| JP | 2010-021828 | 1/2010 |

(Continued)

OTHER PUBLICATIONS

A.J. Simmons, "Circularly Polarized Slot Radiators", IRE Transactions on Antennas and Propagation, vol. 5, pp. 31-36, Jan. 1957.

(Continued)

*Primary Examiner* — Hoang V Nguyen
(74) *Attorney, Agent, or Firm* — Cozen O'Connor

(57) ABSTRACT

The present invention provides a waveguide slot antenna which utilizes a waveguide as a feeding line and has a linear-shaped slot provided in a wall of the waveguide. The waveguide slot antenna is characterized in that it comprises a pair of polarized wave conversion members surrounding an outer periphery of the slot and divided by a slit intersecting the slot. The present invention can provide a waveguide slot antenna capable of radiating a circularly polarized wave with a satisfactory axial ratio characteristic, over a wide band, only by adding a simple component to a conventional waveguide slot antenna.

5 Claims, 9 Drawing Sheets

(a)

(b)

(56) References Cited

FOREIGN PATENT DOCUMENTS

| | | |
|---|---|---|
| JP | 2010-239524 | 10/2010 |
| JP | 2011-015009 | 1/2011 |
| JP | 2012-065229 | 3/2012 |

OTHER PUBLICATIONS

W.J. Getsinger, "Elliptically polarized leaky-wave array,", IRE Transactions on Antennas and Propagation, vol. 10, pp. 165-171, Mar. 1957.

T. Hirano et al., "A Design of a Leaky Waveguide Crossed-Slot Linear Array with a Matching Element by the Method of Moments with Numerical-Eigenmode Basis Functions", The Institute of Electronics, Information and Communication Engineers, vol. E88-B, No. 3, pp. 1219-1226, No. 3, Mar. 2005.

G. Montisci et al., "Waveguide Slot Antennas for Circularly Polarized Radiated Field", IEEE Transactions on Antennas and Propagation, vol. 52, No. 2, pp. 619-623, Feb. 2004.

K. Min et al., "A Circularly Polarized Waveguide Narrow-wall Slot Array using a Single Layer Polarization Converter", IEEE AP-S International Symposium, pp. 1004-1007, 1996.

Hirano et al.," Edge-based FEM analysis for MoM basis functions in a wavegnide cross slot", 1999 IEEE Antennas and Propagation Society International Symposium digest, 1999, vol. 1, pp. 468-471.

* cited by examiner (a)

(b)

WAVEGUIDE SLOT ANTENNA

CROSS-REFERENCE TO RELATED APPLICATION

This application is based on Japanese Patent Application Serial No. 2011-287343 filed in Japan Patent Office on Dec. 28, 2011, the contents of which are hereby incorporated by reference.

BACKGROUND OF THE INVENTION

1. Field of the Invention

The present invention relates to a waveguide slot antenna, and particularly to a structure of a waveguide slot antenna capable of generating a circularly polarized wave.

2. Description of the Related Art

A waveguide slot antenna utilizing a waveguide as a feeding line has been used as an antenna element usable in a microwave band and a millimeter-wave band, in a base station for wireless communication terminals.

In use for wireless communication terminals, there are some situations in which, rather than a linearly polarized wave, a circularly polarized wave less susceptible to fading is desirable. Therefore, in connection with the need for a waveguide slot antenna adapted to radiate a circularly polarized wave, circularly polarized wave antenna devices using various waveguide slot antennas have been proposed.

Basically, a waveguide slot antenna having a linear-shape slot radiates a linearly polarized wave therefrom.

Thus, in a conventional waveguide slot antenna for radiating a circularly polarized wave, a linearly polarized wave is converted into a circularly polarized wave by combining a pair of linear slots to generate mutually orthogonal polarized waves, as disclosed in the following Non-Patent Documents 1 to 5. JP 2012-065229A discloses a waveguide slot antenna in which a linearly polarized wave is converted into a circularly polarized wave by coupling a parasitic element to a linear slot to generate orthogonal polarized wave components.

FIG. 11 is a perspective view illustrating an example of a conventional waveguide slot antenna for radiating a circularly polarized wave. As illustrated in FIG. 11, one wall section of a hollow waveguide 89 has a cross slot 59 composed of a combination of two linear slots 79, 79 and provided offset from a center line CL thereof parallel to an axis of the hollow waveguide 89.

LIST OF PRIOR ART DOCUMENTS

Patent Documents

Patent Document 1: U.S. Pat. No. 6,028,562 A
Patent Document 2: JP 2003-037432 A
Patent Document 3: JP 2000-341030 A
Patent Document 4: JP Application 2011-202765

Non-Patent Documents

Non-Patent Document 1: A. J. Simmons, "Circularly polarized slot radiators," IRE Trans. Antennas Propag., vol. 5, pp. 31-36, January 1957.

Non-Patent Document 2: W. J. Getsinger, "Elliptically polarized leaky-wave array," IRE Trans. Antennas Propag., vol. 10, pp. 165-171, March 1957.

Non-Patent Document 3: T. Hirano, J. Hirokawa and M. Ando, "A design of a leaky waveguide crossed-slot linear array with a matching element by the method of moments with numerical-eigenmode basis functions," IEICE Transactions on Communication, vol. E88-B, No. 3, pp. 1219-1226, September 2004.

Non-Patent Document 4: G. Montisci, M. Musa and G. Mazzarella "Waveguide slot antennas for circularly polarized radiated field", IEEE Trans. Antennas Propag., vol. 52, pp. 619-623, 2004.

Non-Patent Document 5: K. Min, J. Hirokawa, K. Sakurai, M. Ando, N. Goto and Y. Hara, "A Circularly Polarized Waveguide Narrow-wall Slot Array using a Single Layer Polarization Converter," IEEE AP-S International Symposium 1996, pp. 1004-1007.

BRIEF SUMMARY OF THE INVENTION

Technical Problem

Designing for each of the conventional waveguide slot antennas disclosed in the Non-Patent Documents 1 to 5 and the JP 2012-065229A involves complicated calculation, and a resulting circularly polarized wave antenna device can obtain a satisfactory axial ratio only in a narrow band.

Solution to the Technical Problem

In order to solve the above problems, according to one aspect of the present invention, there is provided a waveguide slot antenna which utilizes a waveguide as a feeding line and has a linear slot provided in a wall of the waveguide. The waveguide slot antenna is characterized in that it comprises a pair of polarized wave conversion members surrounding an outer periphery of the slot and divided by a slit intersecting the slot.

According to another aspect of the present invention, there is provided a waveguide slot antenna which utilizes a waveguide as a feeding line and has a linear slot provided in a wall of the waveguide. The waveguide slot antenna is characterized in that it comprises a flat-shaped conductor plate which has a first through-hole formed in a shape approximately identical to that of the slot and provided at a position opposed to the slot, and a second through-hole provided at a position intersecting the first through-hole.

Effect of the Invention

The present invention can provide a waveguide slot antenna capable of radiating a circularly polarized wave with a satisfactory axial ratio characteristic, over a wide band, only by adding a simple component to a conventional waveguide slot antenna.

DETAILED DESCRIPTION OF THE INVENTION

First Embodiment

The present invention will now be described based on a first embodiment thereof with reference to FIGS. 1 to 3(*b*).

Figure 1:
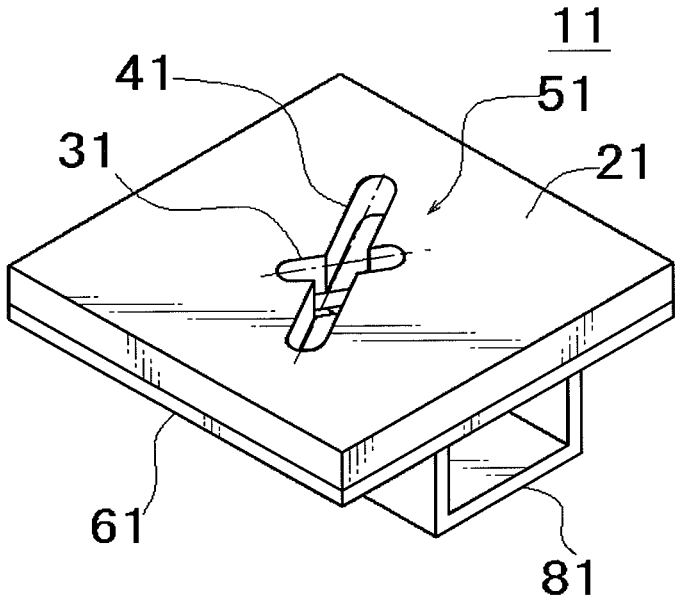
FIG. 1 is a perspective view of a waveguide slot antenna according to a first embodiment of the present invention.
Figure 2:
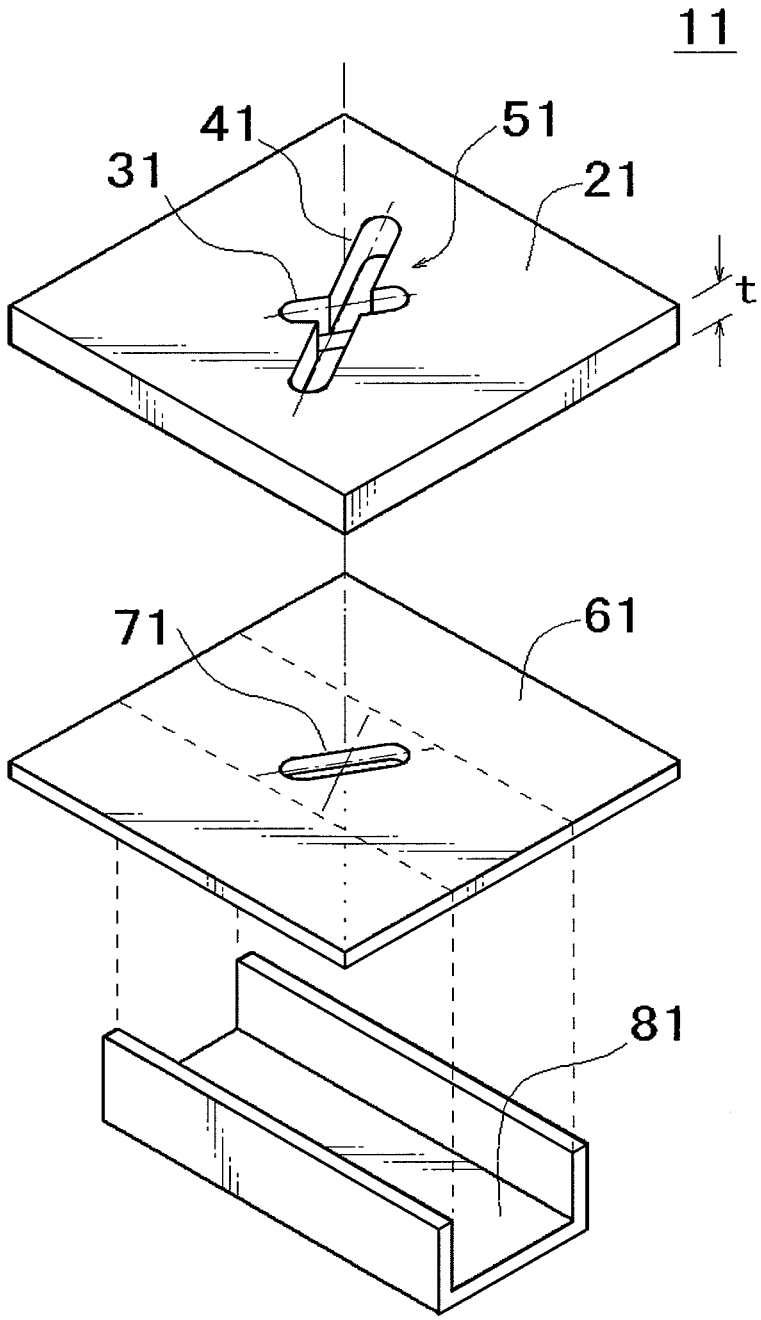
FIG. 2 is an exploded perspective view of the waveguide slot antenna in FIG. 1.

As illustrated in FIGS. 1 to 2, a waveguide slot antenna 11 according to the first embodiment of the present invention comprises: a waveguide member 81 composed of a cross-sectionally angular U-shaped conductor having an opening on one side thereof; a flat-shaped slot plate 61 composed of a conductor having a linear slot 71 and disposed to cover the opening while allowing the slot 71 to be located inside the opening, so as to form a waveguide; and a flat-shaped polarized wave conversion/radiation plate 21 disposed in superimposed relation to the slot plate 61, wherein the polarized wave conversion/radiation plate 21 is composed of a conductor having a cross slot 51 which consists of a first through-hole 31 formed in a shape approximately identical to that of the slot 71 and provided at a position opposed to the slot 71, and a second through-hole 41 formed in a linear shape and provided at a position intersecting the first through-hole 31.

Figure 3:
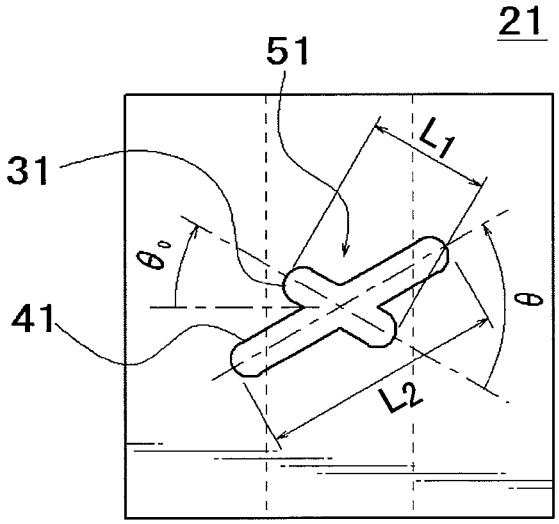
FIGS. 3(*a*) and 3(*b*) are explanatory diagrams illustrating details of the waveguide slot antenna in FIG. 1.
Figure 3:
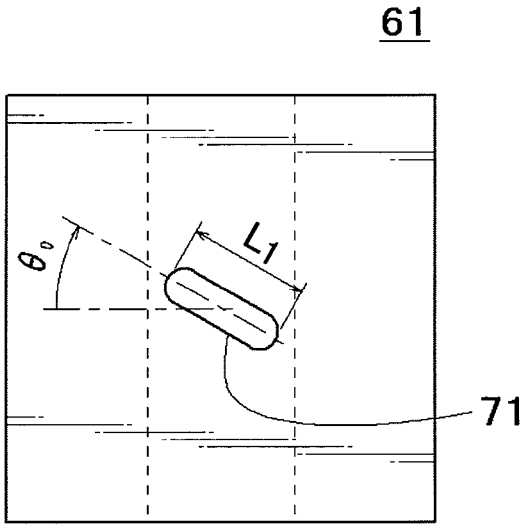

FIGS. 3(*a*) and 3(*b*) are plan views for explaining the polarized wave conversion/radiation plate 21 and the slot plate 61, wherein FIG. 3(*a*) is a plan view of the polarized wave conversion/radiation plate 21, and FIG. 3(*b*) is a plan view of the slot plate 61.

As illustrated in FIG. 3(*a*), in the polarized wave conversion/radiation plate 21, the first through-hole 31 is provided to have a longitudinal length L1, and the second through-hole 41 is provided to have a longitudinal length L2 and intersect the first through-hole 31 at a predetermined intersection angle θ. As illustrated in FIG. 3(*b*), in the slot plate 61, the slot 71 is provided to have the longitudinal length L1.

The slot 71 has a shape approximately identical to that the first through-hole 31, and each of the slot 71 and the first through-hole 31 is formed at a position rotated by $\theta_0$ with respect to a plane perpendicular to an axis of the waveguide.

The longitudinal length L2 of the second through-hole 41 is greater than the longitudinal length L1 of the first through-hole 31.

The intersection angle θ between the first through-hole 31 and the second through-hole 41 is set in the following range: −90 degrees<θ<90 degrees (where θ≠0).

The polarized wave conversion/radiation plate 21 has a thickness t which is 0.2 to 0.3 times a length of wavelength in the waveguide.

Through the cross slot 51 consisting of the mutually intersecting first and second through-holes 31, 41, an electric field B orthogonal to an electric field A from the slot 71 is generated. When the electric field A and the electric field B are orthogonal to each other, and a phase difference therebetween is 90 degrees, a synthetic wave of the electric field A and the electric field B will become a circularly polarized wave.

A rotation direction of the circularly polarized wave is determined by the intersecting angle θ.

When the second through-hole 41 is disposed at a position rotated in a counterclockwise direction (θ>0) with respect to the first through-hole 31, the antenna will generates a left-handed circularly polarized wave.

The intersection angle θ is selected to provide a satisfactory axial ratio characteristic. For example, it may be set in the following range: 30 degrees≤θ<90 degrees.

The angle $\theta_0$ of the slot 71 with respect to the plane perpendicular to the axis of the waveguide is an arbitrary value, and the slot 71 may be disposed at an arbitrary angle so as to facilitate impedance matching.

Second Embodiment

Due to the polarized wave conversion/radiation plate having a relatively large thickness, the waveguide slot antenna for a circularly polarized wave (circularly polarized waveguide slot antenna) illustrated in FIG. 1 significantly increases in weight, as compared to a waveguide slot antenna for a linearly polarized wave (linearly polarized waveguide slot antenna).

As a result of experimental tests, the inventors have found that, even in a structure where a large portion of the polarized wave conversion/radiation plate is removed while leaving only a portion around the slot, so as to facilitate a reduction in weight, the resulting waveguide slot antenna can operate as an antenna capable of radiating a circularly polarized wave with a satisfactory axial ratio characteristic over a wide band.

Figure 4:
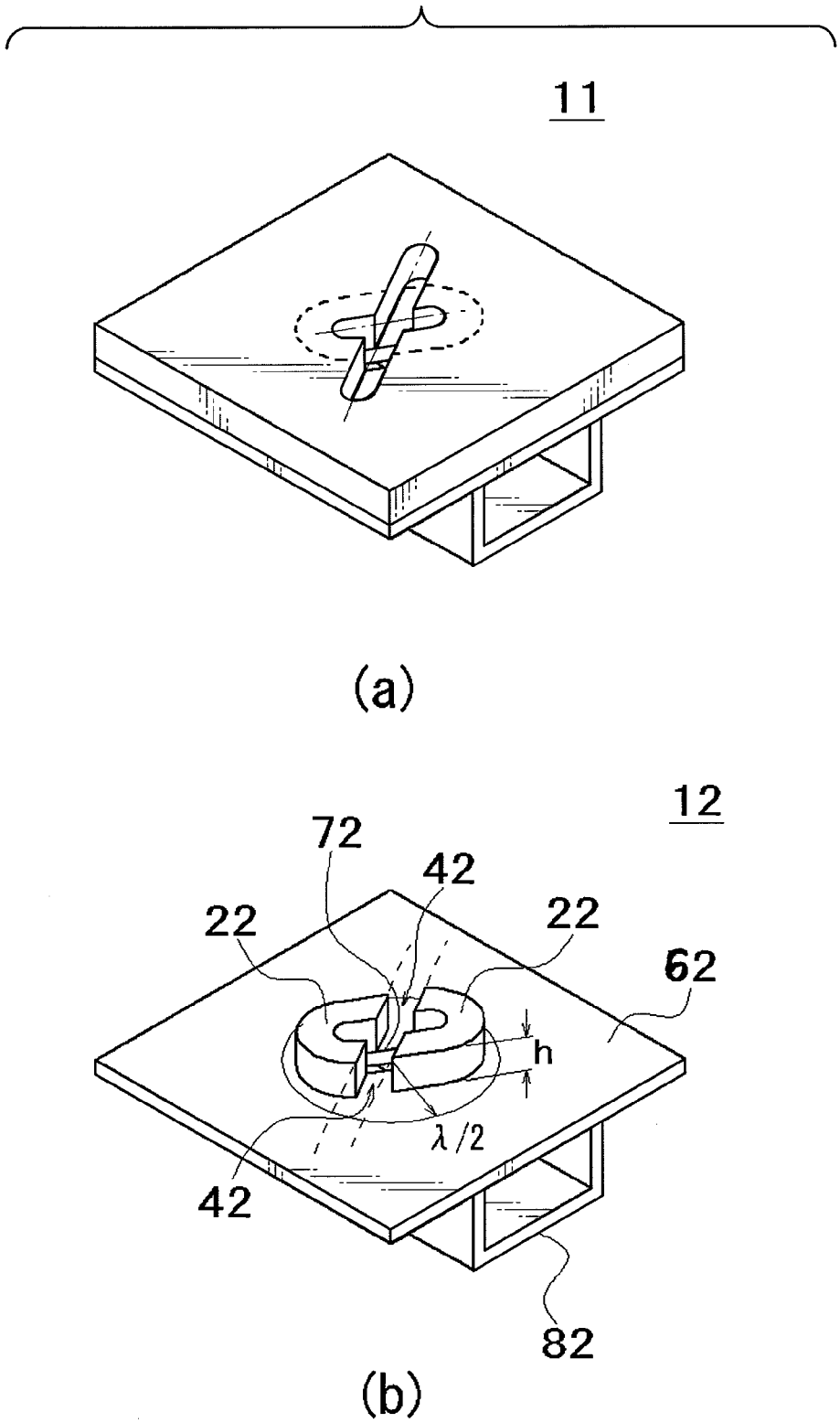
FIGS. 4(*a*) and 4(*b*) are perspective views of a waveguide slot antenna according to a second embodiment of the present invention.

FIGS. 4(*a*) and 4(*b*) are explanatory diagrams of a waveguide slot antenna according to a second embodiment of the present invention, wherein FIG. 4(*a*) is a perspective view for explaining the second embodiment, compared to the first embodiment, and FIG. 4(*b*) is a perspective view for explaining the waveguide slot antenna according to the second embodiment in detail.

As illustrated in FIG. 4(*a*), when the polarized wave conversion/radiation plate of the waveguide slot antenna 11 illustrated in FIG. 1 is mostly cut away while leaving only a region surrounded by the dotted line in FIG. 1, a waveguide slot antenna 12 according to the second embodiment of the present invention is obtained as illustrated in FIG. 4(*b*).

As illustrated in FIG. 4(*b*), the waveguide slot antenna 12 according to the second embodiment comprises: a waveguide member 82 composed of a cross-sectionally angular U-shaped conductor having an opening on one side thereof; a flat-shaped slot plate 62 composed of a conductor having a linear slot 72 and disposed to cover the opening while allowing the slot 72 to be located inside the opening, so as to form a waveguide; and a pair of polarized wave conversion members 22, 22 surrounding an outer periphery of the slot 72 and divided by a linear slit 42 intersecting the slot 72. The polarized wave conversion members 22, 22 are arranged point-symmetrically with respect to a center of the slot 72.

Preferably, each of the polarized wave conversion members 22, 22 has a height dimension h which is 0.2 to 0.3 times a length of a wavelength in the waveguide, and the polarized wave conversion members 22, 22 are preferably arranged within one-half of the wavelength, with respect to the center of the slot.

In the waveguide slot antenna 12, a combination of the slot 72 and the slit 42 can be considered as a pseudo cross slot. Thus, the waveguide slot antenna 12 can radiate a circularly polarized wave, as with the waveguide slot antenna 11 according to the first embodiment.

Third to Fourth Embodiments

Figure 5:
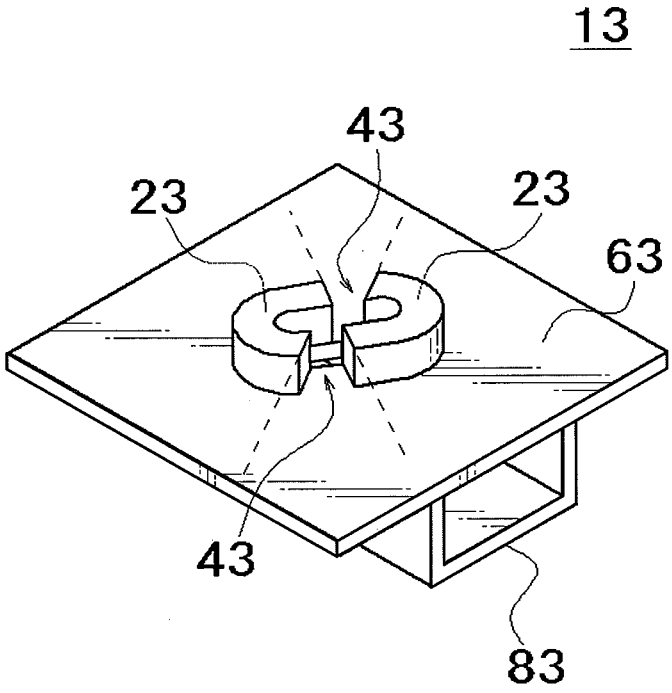
FIG. 5 is a perspective view of a waveguide slot antenna according to a third embodiment of the present invention.

FIG. 5 is a perspective view of a waveguide slot antenna 13 according to a third embodiment of the present invention. As illustrated in FIG. 5, the waveguide slot antenna 13 according to the third embodiment has the same structure as the waveguide slot antenna 12 according to the second embodiment, except that a slit 43 has a non-linear shape. Specifically, the slit 43 is radially expanded in a direction away from a center of the linear slot 72 so as to facilitate impedance matching. The change in shape of the slit makes it possible to reduce a return loss.

Figure 6:
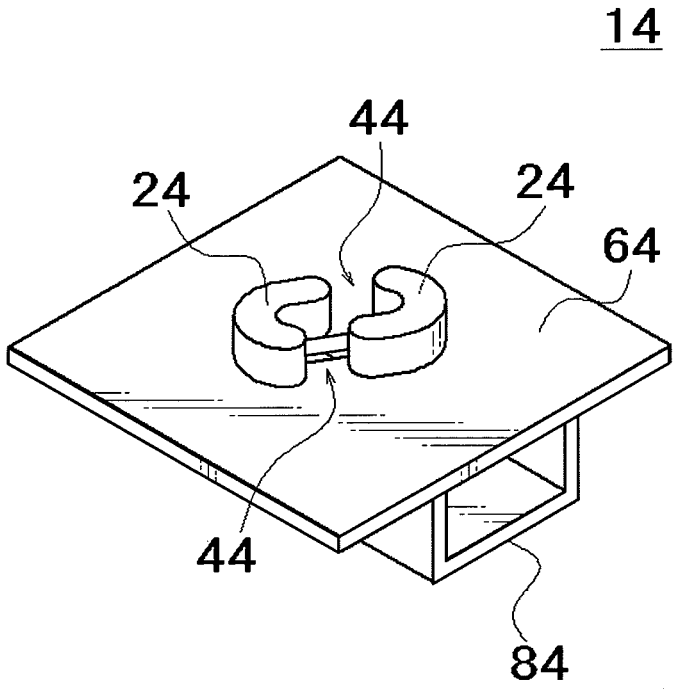
FIG. 6 is a perspective view of a waveguide slot antenna according to a fourth embodiment of the present invention.

FIG. 6 is a perspective view of a waveguide slot antenna 14 according to a fourth embodiment of the present invention. As illustrated in FIG. 6, the waveguide slot antenna 14 according to the fourth embodiment has the same structure as the waveguide slot antenna 12 according to the second embodiment, except that corners of each of a pair of polarized wave conversion members 24, 24 are chamfered so as to facilitate impedance matching. The chamfering of corners of each of the polarized wave conversion members 24, 24 makes it possible to reduce a return loss.

Figure 7:
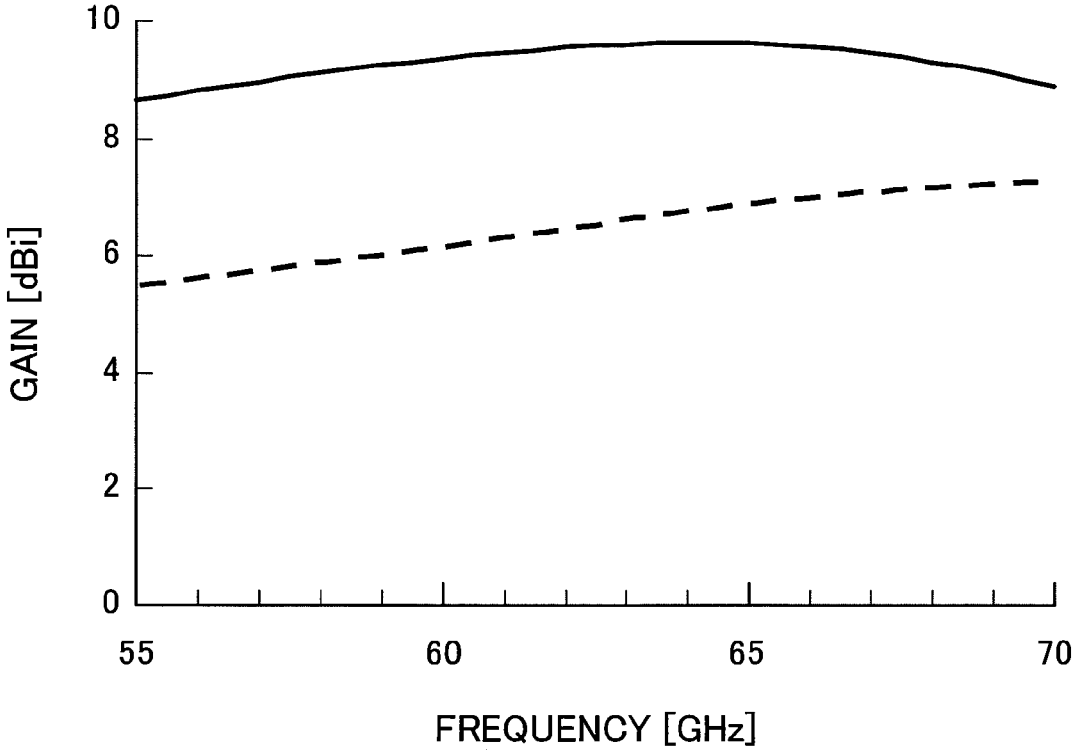
FIG. 7 is a graph illustrating respective gains in the first embodiment and the fourth embodiment.

FIG. 7 is a graph illustrating a comparison between respective gains of the waveguide slot antennas according to the first and fourth embodiments, calculated using an electromagnetic field simulator.

In FIG. 7, the vertical axis represents gain [dBi], and the horizontal axis represents frequency [GHz], wherein the dotted line indicates a gain of the waveguide slot antenna according to the first embodiment, and the solid line indicates a gain of the waveguide slot antenna according to the fourth embodiment. In this test, each of the waveguide slot antennas according to the first and fourth embodiments was formed as a 60 GHz band single element antenna.

As seen in FIG. 7, at a frequency of 60 GHz, the waveguide slot antenna according to the first embodiment had a gain of 6.1 dBi, whereas the waveguide slot antenna according to the fourth embodiment had a gain of 9.4 dBi. This shows that the structure of the waveguide slot antenna according to the fourth embodiment has an advantage of being able to not only reduce an antenna weight but also provide a significantly enhanced gain.

Fifth Embodiment

The waveguide slot antenna of the present invention can be applied to not only a hollow waveguide but also a dielectric waveguide.

Figure 8:
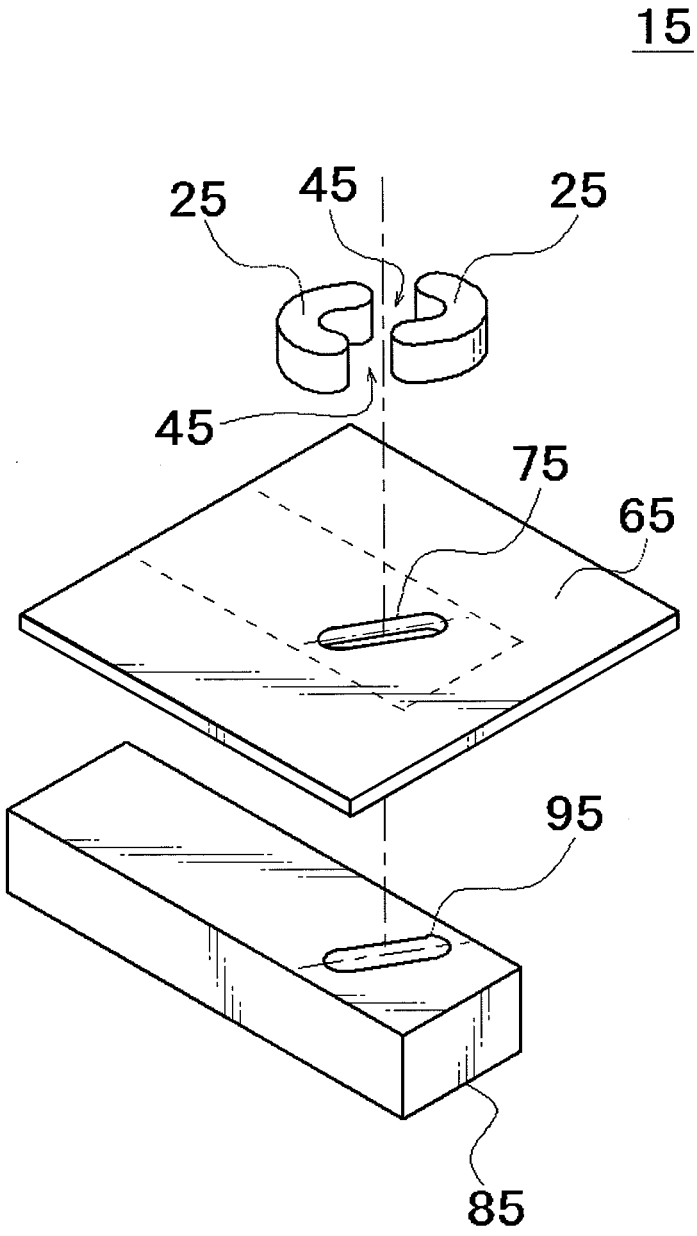
FIG. 8 is an exploded perspective view of a waveguide slot antenna according to a fifth embodiment of the present invention, wherein a technique of the fourth embodiment is applied to a dielectric waveguide.

FIG. 8 is a perspective view illustrating a waveguide slot antenna 15 according to fifth embodiment of the present invention.

As illustrated in FIG. 8, the waveguide slot antenna 15 comprises: a dielectric waveguide member 85 comprised of a rectangular parallelepiped-shaped dielectric body and a conductor film covering a surface of the dielectric body and having a linear dielectric body-exposing area 95 provided in a part of a top region thereof to allow the dielectric body to be exposed therethrough; a flat-shaped slot plate 65 composed of a conductor having a linear slot 75 with a shape approximately identical to that of the dielectric body-exposing area 95 and disposed to allow the slot 75 to be located in opposed relation to the dielectric body-exposing area 95; and a pair of polarized wave conversion members 25, 25 surrounding an outer periphery of the slot 75 and divided by a slit 45 intersecting the slot 75.

Figure 9:
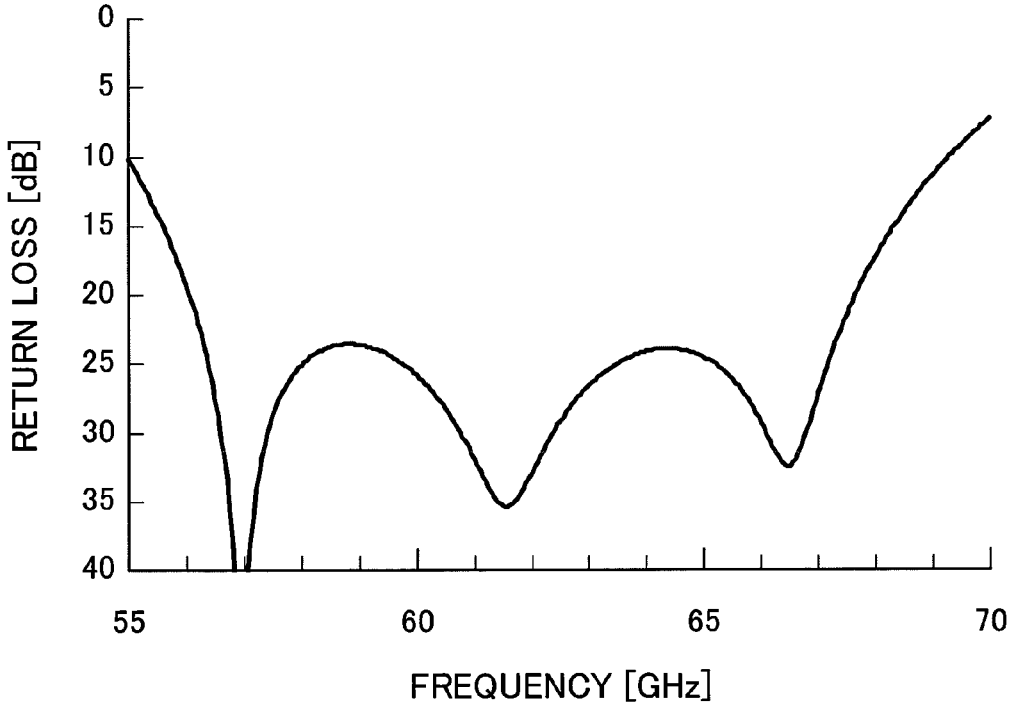
FIG. 9 is a graph illustrating a return loss in the dielectric waveguide slot antenna in FIG. 8.

FIG. 9 is a graph illustrating a return loss characteristic of the waveguide slot antennas according to the fifth embodiment, calculated using an electromagnetic field simulator. In FIG. 9, the vertical axis represents return loss [dB], and the horizontal axis represents frequency [GHz].

As seen in FIG. 9, in a frequency range of 55 GHz to 70 GHz, a fractional bandwidth having a return loss of 20 dB or more is about 18%.

Figure 10:
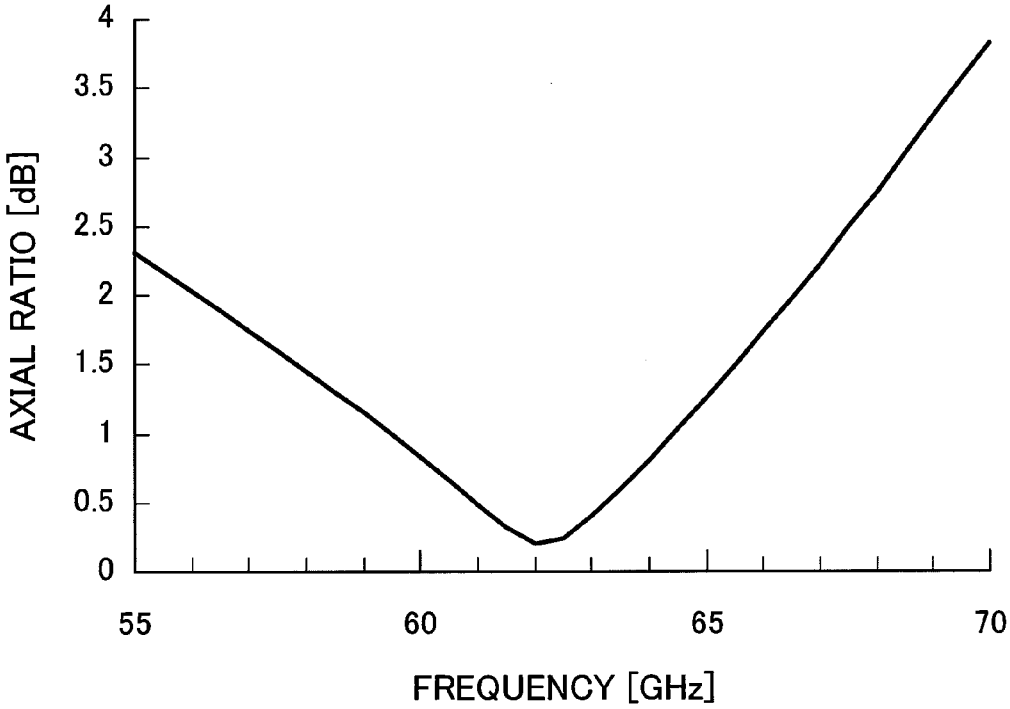
FIG. 10 is a graph illustrating an axial ratio characteristic of the dielectric waveguide slot antenna in FIG. 8.
Figure 11:
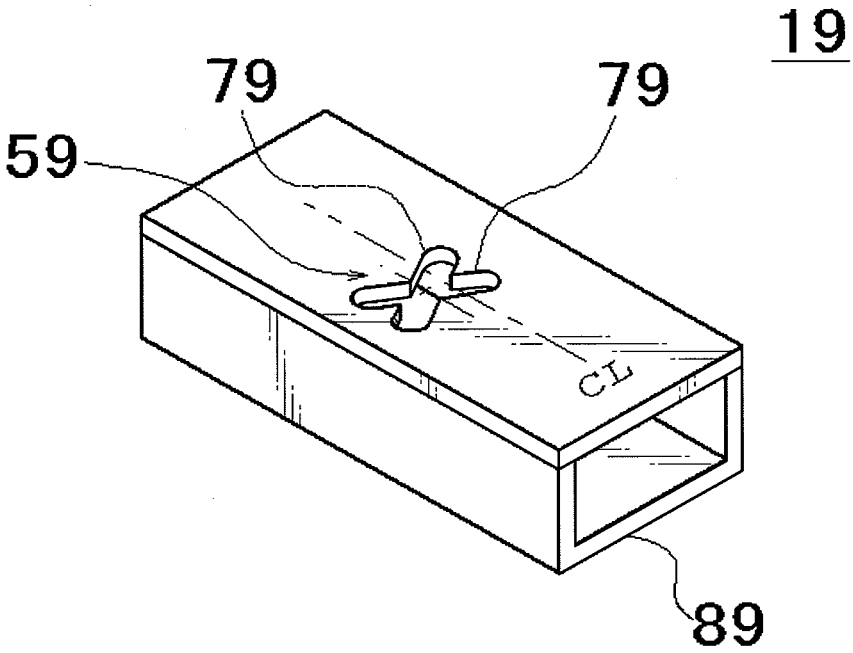
FIG. 11 is a perspective view of a conventional waveguide slot antenna.

FIG. 10 is a graph illustrating an axial ratio characteristic of the dielectric waveguide slot antenna according to the fifth embodiment. In FIG. 10, the vertical axis represents axial ratio [dB], and the horizontal axis represents frequency [GHz].

As seen in FIG. 10, in a frequency range of 55 GHz to 70 GHz, a fractional bandwidth having an axial ratio characteristic of 2 dB or less is about 17%.

As seen in the results in FIGS. 9 and 10, in a frequency range having a return loss of 20 dB or less, the axial ratio is 2 dB or less, which shows that a significantly wide band characteristic is obtained.

As described in the above embodiments, a waveguide slot antenna capable of radiating a circularly polarized wave can be obtained, simply by: adding, to a waveguide slot antenna comprising a waveguide and a linear-shaped slot provided in a wall of the waveguide, a polarized wave conversion/radiation plate provided with a cross slot consisting of mutually intersecting first and second through-holes; or providing, to a waveguide slot antenna comprising a waveguide and a linear-shaped slot provided in a wall of the waveguide, a pair of polarized wave conversion members around an outer periphery of the slot.

The waveguide slot antenna of the present invention can be applied to not only a single element antenna but also an array antenna.

EXPLANATION OF CODES

11, 12, 13, 14, 15, 19: waveguide slot antenna
21: polarized wave conversion/radiation plate
22, 23, 24, 25: polarized wave conversion member
31, 41, 71, 75: through-hole
42, 43, 44, 45: slit
51, 59: cross slot
61, 62, 63, 64, 65: slot plate
71, 75, 79: slot
81, 82, 83, 84, 89: hollow waveguide
85: dielectric waveguide
95: dielectric body-exposing area

What is claimed is:

1. A waveguide slot antenna utilizing a waveguide as a feeding line and having a linear slot provided in a wall of the waveguide, the waveguide slot antenna comprising a pair of polarized wave conversion members surrounding an outer periphery of the slot and divided by a slit intersecting the slot.

2. The waveguide slot antenna as defined in claim 1, wherein each of the polarized wave conversion members has a height dimension which is 0.2 to 0.3 times a length of a wavelength of use.

3. The waveguide slot antenna as defined in claim 2, wherein the polarized wave conversion members are arranged within one-half of the wavelength, with respect to a center of the slot.

4. The waveguide slot antenna as defined in claim 3, wherein the waveguide is a hollow waveguide or a dielectric waveguide.

5. An array antenna device comprising the waveguide slot antenna as defined in claim 1.

* * * * *